US007712986B2

(12) United States Patent
DeVore et al.

(10) Patent No.: US 7,712,986 B2
(45) Date of Patent: May 11, 2010

(54) PRINTHEAD CARRIER FOR AN IMAGING APPARATUS

(76) Inventors: David Wayne DeVore, 3032 Woodfield Cir., Richmond, KY (US) 40475; Timothy John Hawryschuk, 721 Lori La., Lexington, KY (US) 40517; David Kyle Murray, 2304 Patton Ct., Lexington, KY (US) 40509; Stephen Edward Stewart, 949 Winding Oak Trail, Lexington, KY (US) 40511; Randall McClay Stoves, 1601 Newman Dr., Auburn, AL (US) 36830

( * ) Notice: Subject to any disclaimer, the term of this patent is extended or adjusted under 35 U.S.C. 154(b) by 521 days.

(21) Appl. No.: 11/459,392

(22) Filed: Jul. 24, 2006

(65) Prior Publication Data

US 2008/0038037 A1 Feb. 14, 2008

(51) Int. Cl.
*B41J 11/22* (2006.01)

(52) U.S. Cl. ..... 400/352; 347/49; 347/87; 400/175

(58) Field of Classification Search ..... 400/56, 400/59, 352, 354–355; 347/49, 86, 320, 347/87

See application file for complete search history.

(56) References Cited

U.S. PATENT DOCUMENTS

| | | | | |
|---|---|---|---|---|
| 4,856,919 | A * | 8/1989 | Takeuchi et al. | 400/18 |
| 4,907,018 | A * | 3/1990 | Pinkerpell et al. | 346/139 R |
| 6,378,985 | B2 | 4/2002 | McArdle et al. | |
| 6,481,829 | B1 * | 11/2002 | Bailey et al. | 347/49 |
| 6,547,363 | B1 * | 4/2003 | Shinada et al. | 347/19 |
| 6,609,788 | B2 * | 8/2003 | Hatasa et al. | 347/86 |

* cited by examiner

*Primary Examiner*—Daniel J Colilla
*Assistant Examiner*—Marissa L Ferguson-Samreth

(57) ABSTRACT

An imaging apparatus includes a printhead carrier for mounting a printhead cartridge. The printhead carrier includes a carrier back wall having an upper portion. A back portion of a printhead cartridge cradle is connected to the carrier back wall. A first proximal end of a latch lever is pivotably attached to a front portion of the printhead cartridge cradle. The latch lever has at least one cam follower, with each cam follower being located near the first distal end of the latch lever. A second proximal end of a carrier lid is pivotably attached to the upper portion of the carrier back wall. Each cam of the carrier lid is formed near a second distal end of the carrier lid, and each cam is positioned for progressive engagement by a corresponding cam follower as the latch lever is moved from an open position toward a latched position.

20 Claims, 8 Drawing Sheets

PRINTHEAD CARRIER FOR AN IMAGING APPARATUS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to an imaging apparatus, and more particularly to those having or using a printhead carrier.

2. Description of the Related Art

In the prior art, an imaging apparatus, such as an ink jet printer, forms an image on a print medium, such as paper, by applying ink to the print medium. Such an ink jet printer includes a reciprocating printhead carrier that transports one or more ink jet printhead cartridges across the print medium along a bi-directional scanning path defining a print zone of the printer. An ink jet printhead cartridge, for example, includes both an ink tank containing ink and an ink jet microfluid ejection device, i.e., ink jet printhead, for selectively ejecting the ink. Each ink jet printhead cartridge is mounted to the printhead carrier.

In the printing industry, there is an increasing desire to reduce size. Accordingly, every component is under scrutiny for optimal performance with minimal size. It is typical for printers to have carrier latches that hold their respective printhead cartridges in place on the printhead carrier. However, such carrier latches may involve several moving parts that often complicate the process of latching. Also, such carrier latches are designed such that a lid swings upward to permit the printhead cartridge to be loaded from the top. Further, such prior carrier latches may be oversized, as well as inefficient from a usability perspective, and provide little or no mechanical advantage to the user during latching.

SUMMARY OF THE INVENTION

The present invention, in one form thereof, is directed to an imaging apparatus. The imaging apparatus includes a guide frame, and a printhead carrier coupled to the guide frame for mounting a printhead cartridge. The printhead carrier includes a carrier back wall having an upper portion and a lower portion. A printhead cartridge cradle has a front portion and a back portion, the back portion being connected to the carrier back wall. A latch lever has a first proximal end and a first distal end, the first proximal end being pivotably attached to the front portion of the printhead cartridge cradle. The latch lever has at least one cam follower, with each cam follower being located near the first distal end. A carrier lid has a second proximal end, a second distal end, at least one cam, an interior and an exterior. The second proximal end is pivotably attached to the upper portion of the carrier back wall. Each cam is formed at the exterior near the second distal end, and each cam is positioned for progressive engagement by a corresponding cam follower as the latch lever is moved from an open position toward a latched position.

The present invention, in another form thereof, is directed to a printhead carrier for mounting a printhead cartridge. The printhead carrier includes a carrier back wall having an upper portion and a lower portion. A printhead cartridge cradle has a front portion and a back portion, the back portion being connected to the carrier back wall. A latch lever has a first proximal end and a first distal end, the first proximal end being pivotably attached to the front portion of the printhead cartridge cradle. The latch lever has a first cam follower spaced apart from a second cam follower. Each of the first cam follower and the second cam follower is located near the first distal end. A carrier lid has a second proximal end, a second distal end, a first cam, a second cam, an interior and an exterior. The second proximal end is pivotably attached to the upper portion of the carrier back wall. The first cam and the second cam are formed at the exterior near the second distal end. The first cam is positioned for progressive engagement by the first cam follower and the second cam is positioned for progressive engagement by the second cam follower as the latch lever is moved from an open position toward a latched position.

BRIEF DESCRIPTION OF THE DRAWINGS

The above-mentioned an other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
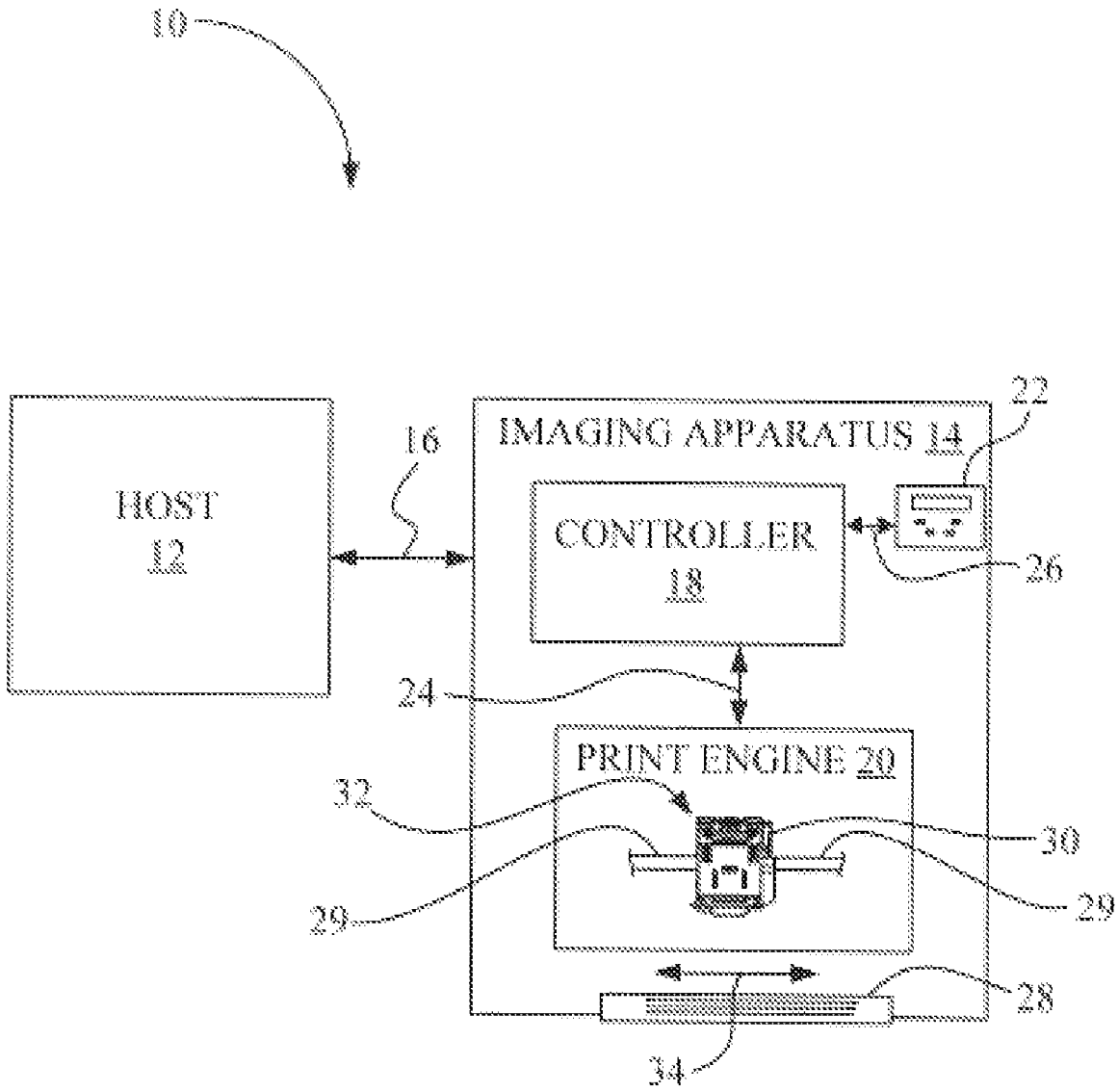
FIG. 1 is a diagrammatic depiction of an imaging system embodying the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Also, as used herein, "at least one of" means one or more.

In addition, it should be understood that some embodiments of the invention may include both hardware and electronic components of modules that, for purposes of discussion, any be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

Referring to FIG. 1, there is shown a diagrammatic depiction of an imaging system 10 embodying the present invention. Imaging system 10 may include a host 12 and an imaging apparatus 14. Imaging apparatus 14 communicates with host 12 by way of a communications link 16. Communications link 16 may be established by a direct cable connection, wireless connection or by a network connection such as for example an Ethernet local area network (LAN). As used herein, the term "imaging apparatus" is a device that forms a printed image on a print medium.

Alternatively, imaging apparatus 14 may be a standalone unit that is not communicatively linked to a host, such as host 12. For example, imaging apparatus 14 may take the form of an all-in-one, i.e., multifunction, machine that includes standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation, host 12 may include in its memory a software program including program instructions that function as an imaging driver, e.g., printer driver software, for imaging apparatus 14. Alternatively, the imaging driver may be incorporated, in whole or in part, in imaging apparatus 14.

Figure 2:
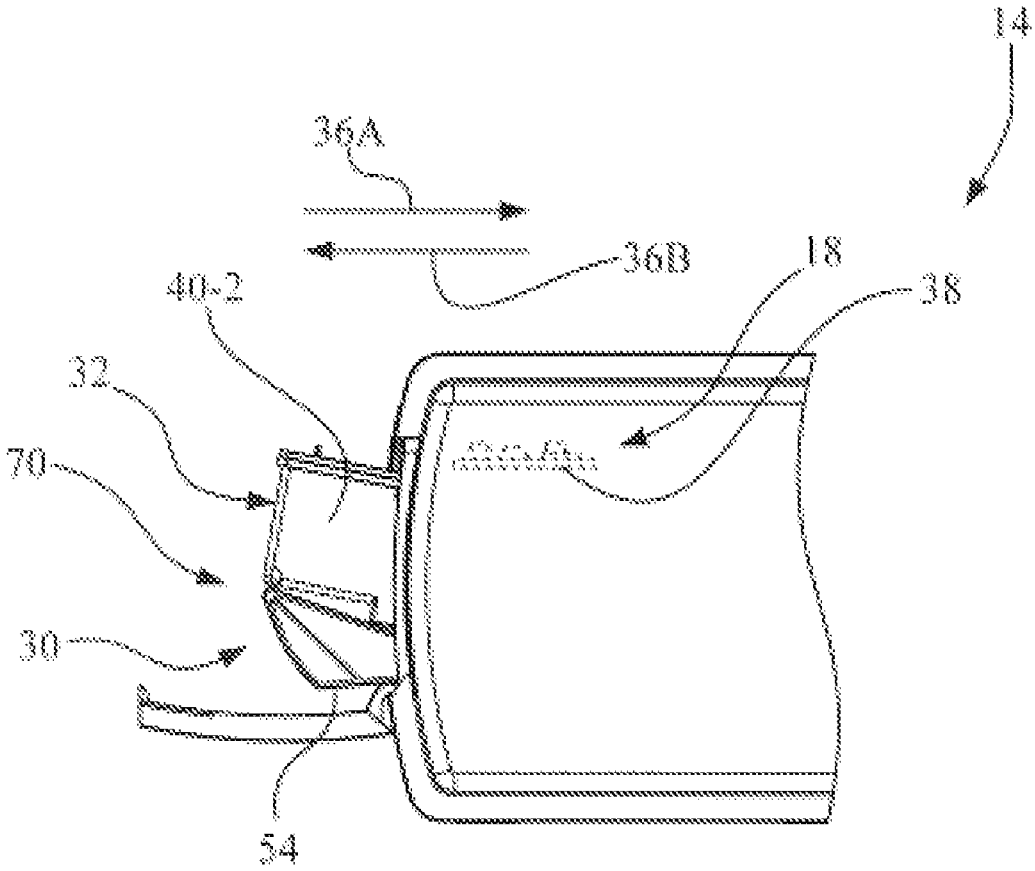
FIG. 2 is a side view of a portion of the imaging apparatus shown in FIG. 1.

In the embodiment of FIG. 1, imaging apparatus 14 includes a controller 18, a print engine 20 and a user interface 22. FIG. 2 shows a side view of imaging apparatus 14, in the form of a compact ink jet printer.

Controller 18 includes a processor unit and associated memory, and may be formed as an Application Specific Integrated Circuit (ASIC). Controller 18 communicates with print engine 20 by way of a communications link 24. Controller 18 communicates with user interface 22 by way of a communications link 26. Communications links 24 and 26 may be established, for example, by using standard electrical cabling or bus structures, or by wireless connection.

Print engine 20 may be, for example, an ink jet print engine configured for forming an image on a sheet of print media 28, such as a sheet of paper, transparency or fabric. Print engine 20 may include, for example, a guide frame 29 and a reciprocating printhead carrier 30 slidably coupled to guide frame 29. Printhead carrier 30 is mechanically and electrically configured to mount and carry at least one printhead cartridge 32. During a printing operation, guide frame 29 guides printhead carrier 30 back and forth along a bi-directional main scan path 34, and in turn printhead carrier 30 transports printhead cartridge 32 in a reciprocating manner over an image surface of the sheet of print media 28.

FIG. 2 shows imaging apparatus 14 with printhead carrier 30 in an open position so as to receive printhead cartridge 32. Printhead cartridge 32 is installed from the front of imaging apparatus 14 toward the back of imaging apparatus 14 in a direction 36A. Direction 36B is a direction opposite to direction 36A. Directions 36A and 36B are substantially perpendicular to bi-directional main scan direction, i.e., axis, 34 (see FIG. 1). Since imaging apparatus 14 is configured to facilitate front loading of printhead cartridge 32, electronic components, such as a printed circuit board 38 (shown in dashed lines) including controller 18, may be positioned at a location above printhead carrier 30, thereby contributing to a reduction of the footprint of imaging apparatus 14 when compared to top loading designs.

Figure 3A:
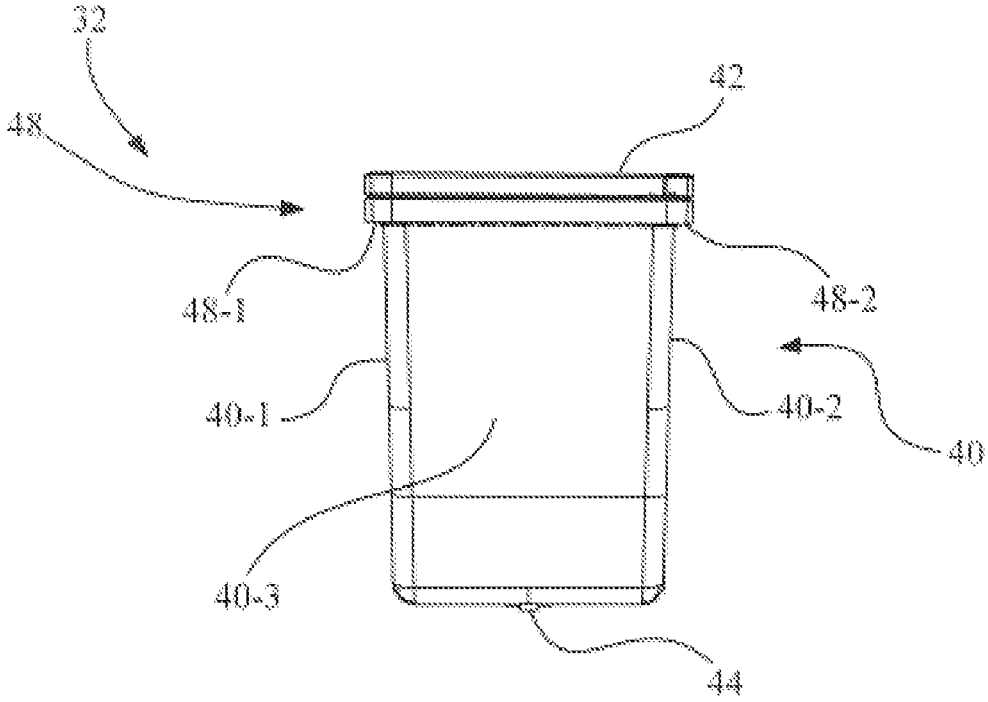
FIG. 3A is an end view of a printhead cartridge.
Figure 3B:
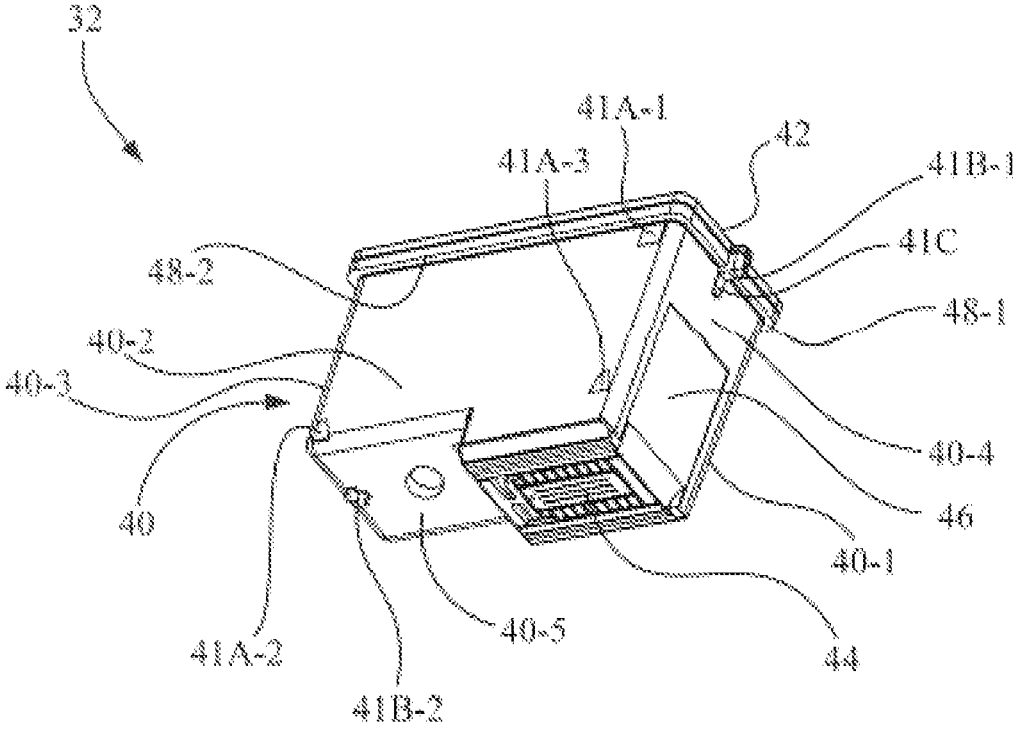
FIG. 3B is a bottom perspective view of the printhead cartridge of FIG. 3A.
Figure 4:
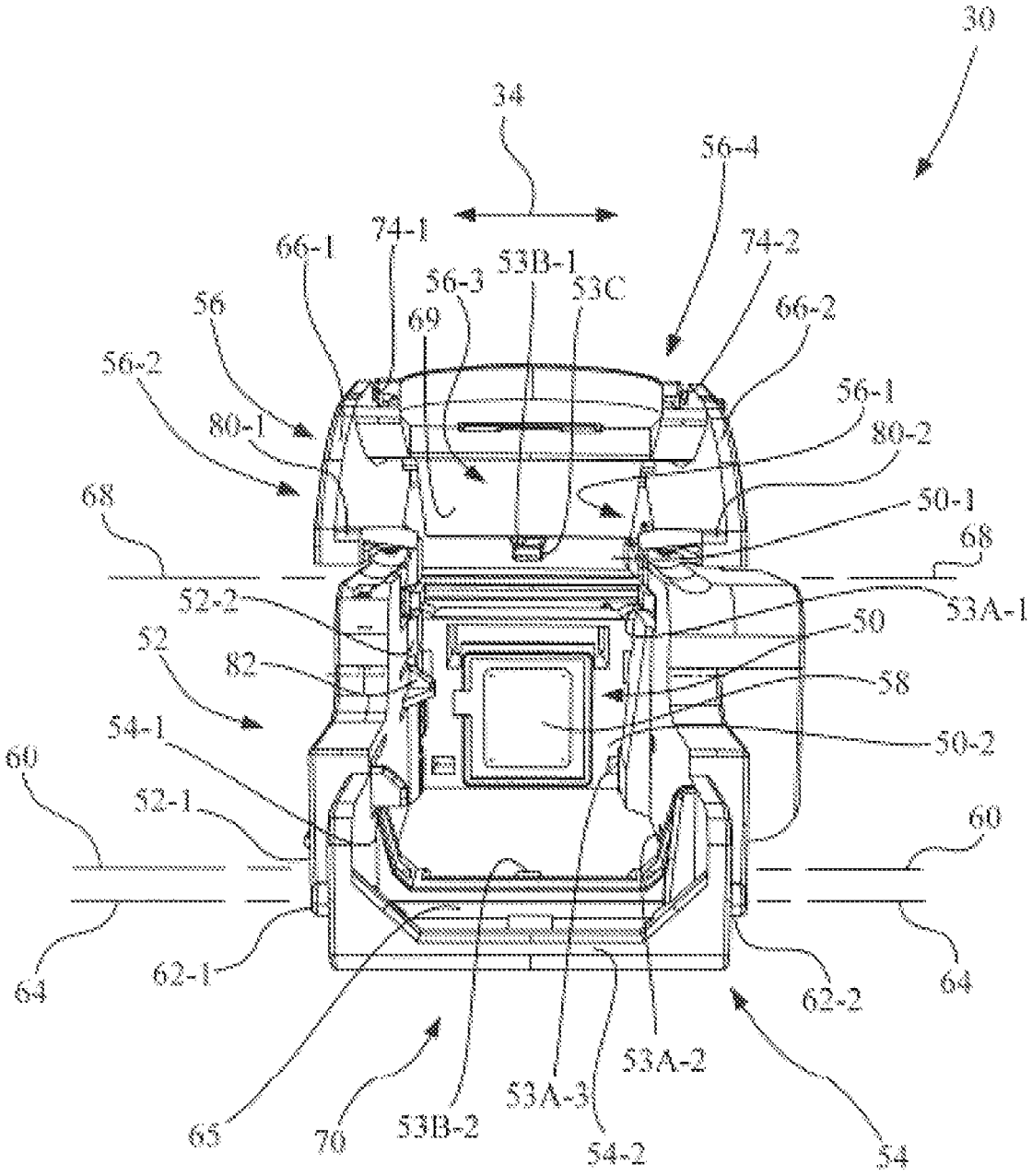
FIG. 4 is an end view of a printhead carrier in the fully open position.

FIGS. 3A and 3B show a front view, and a bottom perspective view, respectively, of printhead cartridge 32. Printhead cartridge 32 includes a reservoir body 40, a top cover 42 and an ink jet printhead 44. Reservoir body 40 includes a first side 40-1, a second side 40-2, a front side 40-3, a back side 40-4, and a bottom side 40-5. Electrical connections are made to ink jet printhead 44 from controller 18 via a tape automated bond (TAB) circuit 46 located on back side 40-4 of printhead cartridge 32.

Printhead cartridge 32 includes a plurality of positioning datums, individually identified as datums 41A-1, 41A-2, 41A-3, 41B-1, 41B-2, and 41C. Datums 41A-1, 41A-2, and 41A-3 are located on side 40-2. Datum 41B-1 is located on an upper lip just below top cover 42 at back side 40-4. Datum 41B-2 is located on bottom side 40-5 near front side 40-3. Datum 41C is located on an upper portion of back side 40-4 adjacent to datum 41B-1. Datums 41A-1, 41A-2, 41A-3, 41B-1, 41B-2, and 41C may, for example, be in the form of raised surfaces, and are designed to be engaged by corresponding datums in printhead carrier 30.

Ink is contained in reservoir body 40, and top cover 42 completes the enclosure to contain the ink. Fluid passageways (not shown) provide one or more paths for ink to flow from reservoir body 40 to ink jet printhead 44. Reservoir body 40 includes a pair of parallel elongate guide members 48, individually identified as guide member 48-1 and guide member 48-2. Guide member 48-1 and guide member 48-2 extend longitudinally along opposite sides 40-1, 40-2 of reservoir body 40.

Referring now to FIGS. 4 and 5A-5D, printhead carrier 30 includes a carrier back wall 50, a printhead cartridge cradle 52, a latch lever 54 and a carrier lid 56.

Carrier back wall 50 has an upper portion 50-1 and a lower portion 50-2. A set of electrical contacts 58 are provided on carrier back wall 50. The set of electrical contacts 58 are communicatively coupled to controller 18, such as by a multiconductor cable. The set of electrical contacts 58 provide electrical power and signal communication to TAB circuit 46 when printhead cartridge 32 is installed in printhead carrier 30.

Printhead cartridge cradle 52 has a front portion 52-1 and a back portion 52-2. Back portion 52-2 is connected carrier back wall 50. Printhead cartridge cradle 52 includes positioning datums 53A-1, 53A-2, 53A-3 on a side wall thereof, and a datum 53B-2 located on a bottom portion thereof, which are positioned to engage corresponding datums 41A-1, 41A-2, 41A-3, and 41B-2 of printhead cartridge 32. Carrier back wall 50 includes positioning datums 53B-1 and 53C positioned to correspondingly engage datums 41B-1 and 41C of printhead cartridge 32. The datums of printhead carrier 30 define absolute locating positions for positioning printhead cartridge 32 in printhead carrier 30.

Latch lever 54 has a proximal end 54-1 and a distal end 54-2. Proximal end 54-1 of latch lever 54 is pivotably attached to front portion 52-1 of printhead cartridge cradle 52 along a pivot axis 60. Latch lever 54 has a first cam follower 62-1 and a second cam follower 62-2. Each of cam followers 62-1, 62-2 are located near distal end 54-2, and are co-axially arranged along an axis 64. Axis 64 is parallel to pivot axis 60. Attached to latch lever 54 is a leaf spring 65 positioned to engage front side 40-3 of printhead cartridge 32.

Carrier lid 56 has a proximal end 56-1, a distal end 56-2, interior 56-3, an exterior 56-4, an actuator surface 56-5 (see FIG. 5A), a first cam 66-1 and second cam 66-2. Proximal end 56-1 of carrier lid 56 is pivotably attached to upper portion 50-1 of carrier back wall 50 along a pivot axis 68. Pivot axis 68 is parallel to pivot axis 60. Attached to carrier lid 56 is a leaf spring 69 positioned to engage top cover 42 of printhead cartridge 32.

Each cam 66-1, 66-2 is formed at exterior 56-4 of carrier lid 56 near distal end 56-2. Cam 66-1 and cam 66-2 are oriented to be parallel, and each extends in direction 36A from distal end 56-2 of carrier lid 56 to proximal end 56-1 of carrier lid 56. In one embodiment, for example, the spacing between cam 66-1 and cam 66-2 in direction 34 is designed to be sufficient such that printhead cartridge 32 may be received between cam 66-1 and cam 66-2. Each cam 66-1, 66-2 is positioned for progressive engagement by a corresponding cam follower 62-1, 62-2, respectively, of latch lever 54 as latch lever 54 is moved from a full open position 70 (see FIGS. 2 and 4) toward a latched position 72 (see FIG. 5D). Carrier lid 56 pivots in an angular range of 10 degrees to 15 degrees, e.g., from horizontal, when carrier lid is moved from latched position 72 (see FIG. 5D) to full open position 70 (see FIGS. 2 and 4).

Figure 5A:
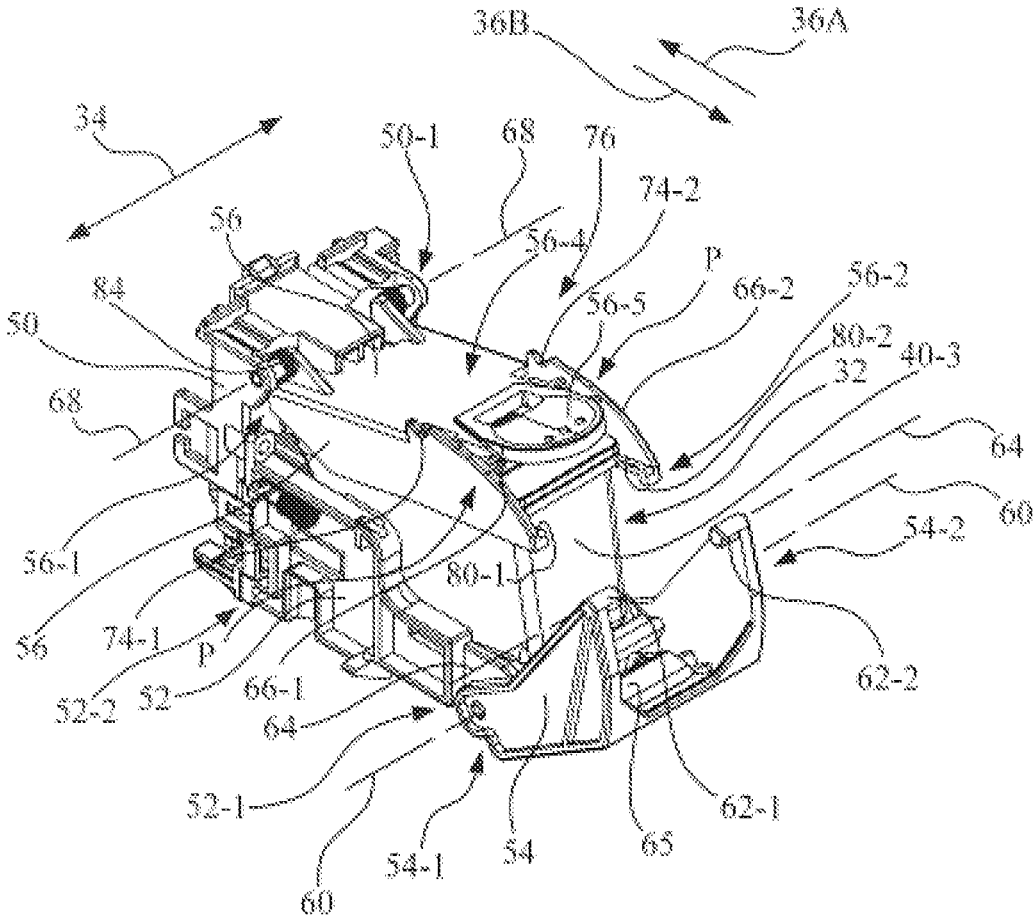
FIG. 5A is a perspective view of the printhead carrier of FIG. 4, at the initial stages of mounting a printhead cartridge.
Figure 5B:
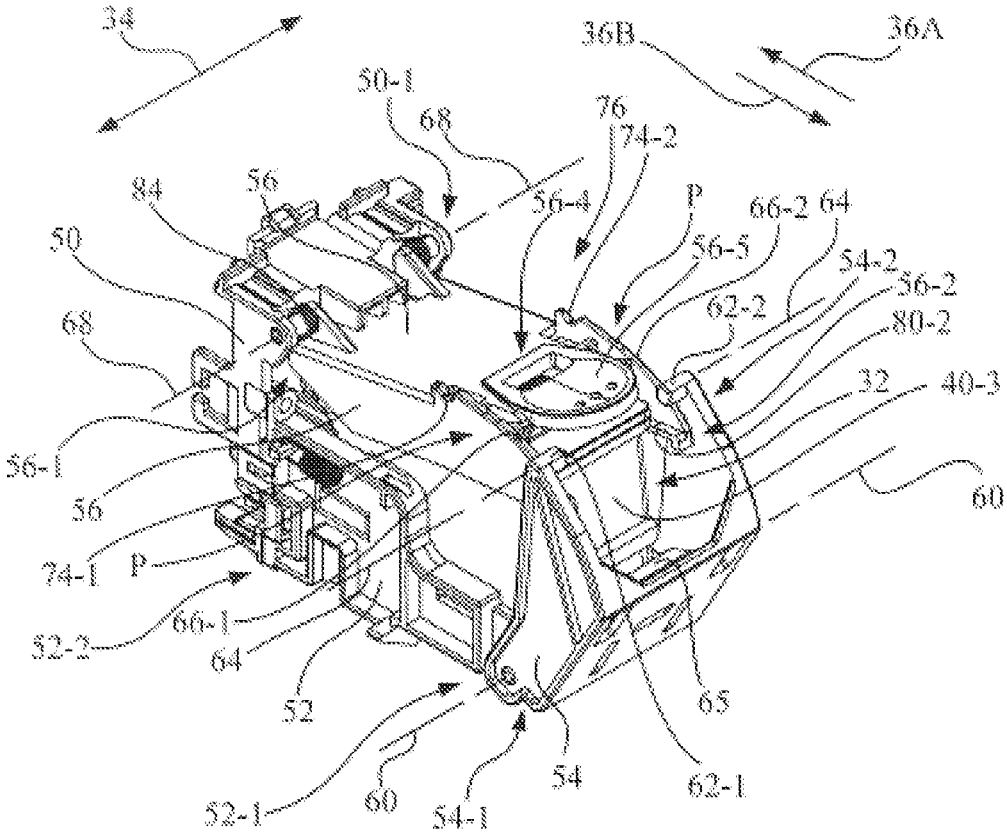
FIG. 5B is a perspective view of the printhead carrier of FIG. 5A, at an intermediate stage of mounting the printhead cartridge.
Figure 5C:
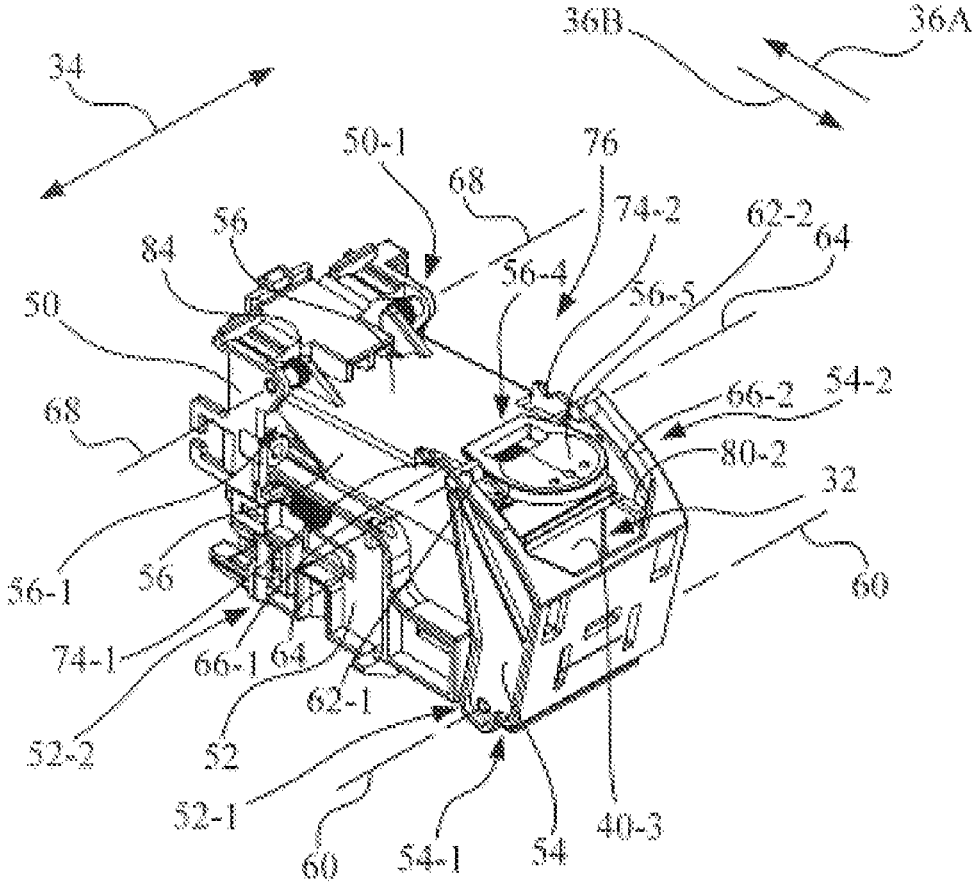
FIG. 5C is a perspective view of the printhead carrier of FIG. 5B at a further intermediate stage of mounting the printhead cartridge.
Figure 5D:
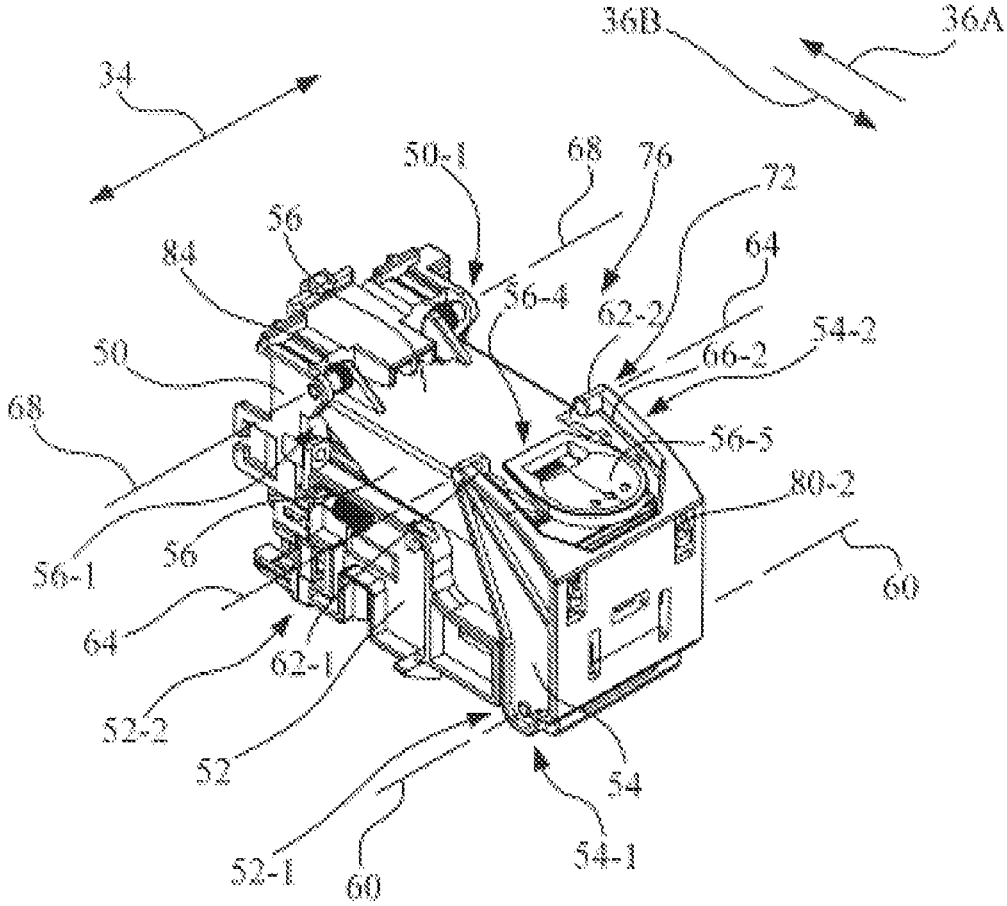
FIG. 5D is a perspective view of the printhead carrier of FIG. 5C with the printhead carrier in the latched position.

Each cam 66-1 and 66-2 has an identical a cam profile P, i.e., shape, that beings at distal end 56-2 of carrier lid 56 and ends at a corresponding detent 74-1 and detent 74-2, respectively, formed at exterior 56-4 at a central region 76 (see FIG. 5A) of carrier lid 56 that is between proximal end 56-1 and distal end 56-2 of carrier lid 56. Each detent 74-1, 74-2 is sized, shaped and positioned to receive a corresponding cam follower 62-1, 62-2, respectively, to define the location of latched position 72, as shown in FIG. 5D.

Carrier lid 56 further includes a pair of elongate guide rails, individually identified as guide rail 80-1 and guide rail 80-2 formed in interior 56-3 of carrier lid 56. Guide rails 80-1, 80-2 are oriented to be parallel, and each extends in direction 36A from distal end 56-2 of carrier lid 56 to proximal end 56-1 of carrier lid 56 to guide printhead cartridge 32 toward carrier back wall 50 as printhead cartridge 32 is loaded into printhead carrier 32. Guide rail 80-1 is spaced apart from guide rail 80-2 in a direction perpendicular to direction 36A, e.g., is spaced apart in a direction parallel to pivot axis 68, i.e., in bi-directional main scan direction 34. The spacing is designed to be sufficient such that printhead cartridge 32 may be received between first guide rail 80-1 and second guide rail 80-2. Accordingly, guide member 48-1 and guide member 48-2 of printhead cartridge 32 are slidably engaged by guide rail 80-1 and guide rail 80-2 of carrier lid 56 as printhead cartridge 32 is loaded into printhead carrier 30.

During a cartridge loading operation, a user inserts the guide members 48-1 and 48-2 of printhead cartridge 32 onto the pair of elongate guide rails 80-1, 80-2 in carrier lid 56. The user then contacts latch lever 54 and rotates latch lever 54 toward carrier back wall 50. At this time, leaf spring 65 of latch lever 54 engages front side 40-3 of printhead cartridge 32 and moves printhead cartridge 32 along the pair of elongate guide rails 80-1, 80-2 in carrier lid 56 into contact with positioning datum 53C on carrier back wall 50 of printhead carrier 30 as latch lever 54 is moved from open position 70 toward latched position 72. Simultaneously, cam followers 62-1, 62-2 of latch lever 54 engage and ride along the profile P of corresponding cams 66-1, 62-2, respectively, to force carrier lid 56 to rotate downwardly toward printhead cartridge cradle 52. During this latching operation, the engagement of cam followers 62-1, 62-2 of latch lever 54 with the arc-shaped cam profile P of the corresponding cams 66-1, 66-2, respectively, of carrier lid 56 provides a mechanical advantage to the user, thereby requiring minimal force to be applied by the user during the latching operation.

As carrier lid 56 rotates downwardly toward printhead cartridge cradle 52, leaf spring 69 of carrier lid 56 engages top cover 42 of printhead cartridge 32 and moves printhead cartridge 32 into contact with positioning datums 53B-1 and 53B-2 on printhead cartridge cradle 52 when latch lever 54 is moved from open position 70 toward latched position 72. A cantilever spring 82 in printhead cartridge cradle 52 forces printhead cartridge 32 into engagement with datums 53A-1, 53A-2 and 53A-3 on the side wall thereof.

When printhead cartridge 32 is moved into contact with positioning datums 53B-1 and 53B-2 on printhead cartridge cradle 52, guide members 48-1 and guide member 48-2 of printhead cartridge 32 are transversely disengaged from guide rail 80-1 and guide rail 80-2 of carrier lid 56, respectively. Leaf spring 65 of latch lever 54 continues to engage front side 40-3 of printhead cartridge 32 to hold printhead cartridge 32 against the positioning datums on carrier back wall 50 of printhead carrier 32 with a compression force when latch lever 54 is in latched position 72.

Printhead cartridge installation is complete when cam followers 62-1, 62-2 engage detents 74-1, 74-2, respectively, of carrier lid 56, as shown in FIG. 5D.

During a printhead cartridge removal operation, a user applies a downward force on a actuator surface 56-5 of carrier lid 56 to cause latch lever 54 to be released from carrier lid 56 by releasing each cam follower 62-1, 62-2 from its corresponding detent 74-1, 74-2, respectively, of carrier lid 56. In turn, leaf spring 65 of latch lever 54 extends from the compressed state to propel latch lever 54 to open position 70 to expose front side 40-3 of printhead cartridge 32 to facilitate extraction of printhead cartridge 32 in a direction 36B opposite to direction 36A, i.e., in a direction away from carrier back wall 50. Also, at this time a torsion spring 84 causes carrier lid 56 to rotate upwardly at an angle of about 12 degrees from horizontal, thereby lifting printhead cartridge 32 from printhead cartridge cradle 52 through the engagement of guide rails 80-1, 80-2 of carrier lid 56 with the corresponding guide members 48-1, 48-2 of printhead cartridge 32. The user may then grasp the opposing side walls 40-1, 40-2 of printhead cartridge 32 (see FIG. 3A) and pull printhead cartridge 32 in a generally lateral direction 36B until printhead cartridge 32 is disengaged from the guide rails 80-1, 80-2 of carrier lid 56.

With the embodiment described above, the latching mechanism of the printhead carrier is as much as 29 percent smaller than some prior designs. Also, user forces needed to latch the printhead carrier have been reduced considerably, in some instances by as much as approximately 200 percent.

While the embodiment described above is directed to an exemplary single printhead cartridge carrier, those skilled in the art will recognize that the concepts of the present invention may be easily applied to a multiple printhead cartridge environment.

The foregoing description of methods and an embodiment of the invention has been presented for purposes of illustration. It is not intended to be exhaustive or to limit the invention to the precise steps and/or forms disclosed, and obviously many modification and variations are possible in light of the above teaching. It is intended that the scope of the invention be defined by the claims appended hereto.

What is claimed is:

1. An imaging apparatus, comprising:

a guide frame; and a printhead carrier coupled to said guide frame for mounting a printhead cartridge, said printhead carrier including:

a carrier back wall having an upper portion and a lower portion;

a printhead cartridge cradle having a front portion and a back portion, said back portion being connected to said carrier back wall;

a latch lever having a first proximal end and a first distal end, said first proximal end being pivotably attached to said front portion of said printhead cartridge cradle, said latch lever having at least one cam follower, each said at least one cam follower being located near said first distal end;

a carrier lid having a second proximal end a second distal end, at least one cam, an interior and an exterior, said second proximal end being pivotably attached to said upper portion of said carrier back wall, said at least one cam being formed at said exterior near said second distal end, said at least one cam being positioned for progressive engagement by a corresponding at least one cam follower as said latch lever is moved from an open position toward a latched position, and an actuator surface disposed on the carrier lid, actuation of said actuator surface releases each said cam follower on the latch lever from a corresponding detent, formed on the carrier lid, so as to release said latch lever from the latched position to the open position.

2. The imaging apparatus of claim 1, said carrier lid having a pair of elongate guide rails formed in said interior of said carrier lid, said pair of elongate guide rails being parallel and extending in a direction from said second distal end to said second proximal end to guide said printhead cartridge toward said carrier back wall as said printhead cartridge is loaded into said printhead carrier.

3. The imaging apparatus of claim 2, wherein said pair of elongate guide rails includes a first guide rail and a second guide rail spaced apart from said first guide rail, said printhead cartridge being received between said first guide rail and said second guide rail.

4. The imaging apparatus of claim 3, wherein said printhead cartridge includes a reservoir body having a first side with a first elongate guide member, and a second side with a second elongate guide member positioned opposite to said first side, said first elongate guide member and said second elongate guide member being parallel and extending longitudinally along said first side and said second side, respectively, to be slidably engaged by said first guide rail and said second guide rail of said carrier lid as said printhead cartridge is loaded into said printhead carrier.

5. The imaging apparatus of claim 4 said carrier back wall of the printhead carrier having formed thereon at least one positioning datum, and said latch lever including a first leaf spring to engage a front side of said printhead cartridge and move said printhead cartridge along said pair of elongate guide rails into contact with said at least one positioning datum on said carrier back wall of the printhead carrier, when said latch lever is moved from said open position toward said latched position.

6. The imaging apparatus of claim 5 said printhead cartridge cradle having formed thereon at least one positioning datum, and said carrier lid including a second leaf spring to engage a top cover of said printhead cartridge and move said printhead cartridge into contact with said at least one positioning datum on said printhead cartridge cradle when said latch lever is moved from said open position toward said latched position.

7. The imaging apparatus of claim 6, wherein when said printhead cartridge is moved into contact with said at least one positioning datum on said printhead cartridge cradle, said first elongate guide member and said second elongate guide member of said printhead cartridge are transversely disengaged from said first guide rail and said second guide rail of said carrier lid,

8. The imaging apparatus of claim 1, wherein said carrier lid pivots in an angular range of 10 degrees to 15 degrees when said carrier lid is moved from said latched position to a full open position.

9. The imaging apparatus of claim 1, said at least one cam having a cam profile that begins at said second distal end of said carrier lid and ends at a central region of said carrier lid between said second proximal end and said second distal end.

10. The imaging apparatus of claim 9, wherein each said cam profile terminates in said central region at a corresponding detent formed at said exterior surface of said carrier lid, each said detent receiving a corresponding cam follower to define said latched position.

11. The imaging apparatus of claim 10, wherein when said latch lever and said carrier lid are in said latched position, a downward force applied by a user to said actuator surface causes said latch lever to be released from said carrier lid by releasing said at least one cam follower from said corresponding detent.

12. The imaging apparatus of claim 11, said latch lever including a first leaf spring positioned to engage a front side of said printhead cartridge to hold said printhead cartridge against at least one positioning datum on said carrier back wall of the printhead carrier with a compression force when said latch lever is in said latched position, and wherein when said latch lever is released from said latched position said first leaf spring propels said latch lever to said open position to expose said front side of said printhead cartridge to facilitate extraction of said printhead cartridge in a direction away from said carrier back wall.

13. The imaging apparatus of claim 1, wherein said cam profile is arc-shaped, and wherein during a latching operation said at least one cam follower of said latch lever engages said arc-shaped cam profile of a corresponding at least one cam of said carrier lid to thereby provide a mechanical advantage to a user during said latching operation.

14. The imaging apparatus of claim 1, wherein said at least one cam follower includes a first cam follower spaced apart from a second cam follower, and said at least one cam includes a first cam and a second cam spaced apart from said first cam, said first cam being positioned for progressive engagement by said first cam follower and said second cam being positioned for progressive engagement by said second cam follower as said latch lever is moved from said open position toward said latched position.

15. The imaging apparatus of claim 14, wherein each of said first cam and said second cam has an are-shaped profile, each of said first cam and said second cam beginning at said second distal end of said carrier lid and ending at a first detent sand a second detent, respectively, located in a central region of said carrier lid between said second proximal end and said second distal end.

16. The imaging apparatus of claim 14, wherein said printhead cartridge is received between said first cam and said second cam.

17. A printhead carrier for mounting a printhead cartridge, comprising:

a carrier back wall having an upper portion and a lower portion;

a printhead cartridge cradle having a front portion and a back portion, said back portion being connected to said carrier back wall;

a latch lever having a first proximal end and a first distal end, said first proximal end being pivotably attached to said front portion of said printhead cartridge cradle, said latch lever having a first cam follower spaced apart from a second cam follower, each of said first cam follower and said second cam follower being located near said first distal end;

a carrier lid having a second proximal end, a second distal end a first cam a second cam, an interior and an exterior said second proximal end being pivotably all attached to said upper portion of said carrier back wall, said first cam and said second cam being formed at said exterior near said second distal end, said first cam being positioned for progressive engagement by said first cam follower and said second cam being positioned for progressive engagement by said second cam follower as said latch lever is moved from an open position toward a latched position, and;

an actuator surface disposed on the carrier lid, actuation of said actuator surface releases the first cam follower and the second cam follower of the latch lever from a corresponding detent formed on the carrier lid so as to release said latch lever from the latched position to the open position.

18. The printhead carrier of claim 17, said carrier lid having a pair of elongate guide rails formed in said interior of said carrier lid, said pair of elongate guide rails being parallel and extending in a direction from said second distal end to said second proximal end to guide said printhead cartridge toward said carrier back wall as said printhead cartridge is loaded into said printhead carrier.

19. The printhead carrier of claim 17, wherein each of said first cam and said second cam has an arc-shaped profile, each of said first cam and said second cam beginning at said second distal end and ending at a first detent and a second detent, respectively, located in a central region between said second proximal end and said second distal end, said first cam follower being received in said first detent and said second cam follower being received in said second detent when said latch lever and said carrier lid are in said latched position.

20. The printhead carrier of claim 19, wherein said actuator surface is located between said first cam and said second cam, wherein when said latch lever and said carrier lid are in said latched position, a downward force applied by a user to said actuator surface causes said latch lever to be released from said carrier lid by simultaneously releasing said first cam follower and said second cam follower from said first detent and said second detent, respectively.

* * * * *